United States Patent [19]

Hincks et al.

[11] Patent Number: 4,940,257

[45] Date of Patent: Jul. 10, 1990

[54] ONE-WRITE BOOK ASSEMBLY WITH REMOVABLE INSERT

[75] Inventors: Daniel A. Hincks, Burlington; William T. Hincks, Madison; Robert W. Hincks, Farmington, all of Conn.

[73] Assignee: Data Management, Inc., Farmington, Conn.

[21] Appl. No.: 416,534

[22] Filed: Oct. 3, 1989

[51] Int. Cl.[5] ..... B41L 3/00

[52] U.S. Cl. ..... 282/29 B; 282/29 A; 282/29 R; 283/66.1; 283/66.2

[58] Field of Search ..... 282/29 B, 29 R

[56] References Cited

U.S. PATENT DOCUMENTS

| | | | |
|---|---|---|---|
| 1,772,032 | 8/1930 | Bottle . | |
| 2,597,579 | 5/1952 | Gleaves | 282/29 B |
| 3,137,517 | 6/1964 | Graff | 282/29 B |
| 3,184,255 | 5/1965 | Rohde | 282/29 B |
| 3,236,542 | 2/1966 | Russell | 282/29 B |
| 3,498,640 | 3/1970 | Russell . | |
| 3,680,969 | 8/1972 | Gorman . | |
| 3,722,922 | 3/1973 | Perez . | |
| 4,201,402 | 5/1980 | Aziz et al. | 282/29 B |
| 4,395,059 | 7/1983 | Russell . | |
| 4,429,901 | 2/1984 | Clery, Jr. et al. . | |
| 4,465,306 | 8/1984 | Hincks, et al. . | |
| 4,591,188 | 5/1986 | Hensel et al. | 282/29 B |

*Primary Examiner*—Paul A. Bell
*Assistant Examiner*—Hwei-Siu Payer

[57] ABSTRACT

A one write bookkeeping assembly has a folded binder with a pair of hinged panels, locating elements spaced along the length of the outer side edge of one panel, and a pocket opening at the fold line therebetween. A removable insert is seated in the binder and has a multiplicity of spaced rings and a multiplicity of record keeping sheets with perforations along one side and through which the rings extend. A pair of mounting panels are supported on the rings, one extending into the pocket and the other extending over the one panel and having apertures adjacent its outer edge through which the locating elements extend. A shingled assembly of overlapping elongated forms is disposed over the record keeping sheet and the forms have apertures along the one side thereof through which said locating elements extend.

11 Claims, 4 Drawing Sheets

ONE-WRITE BOOK ASSEMBLY WITH REMOVABLE INSERT

BACKGROUND OF THE INVENTION

The present invention relates to one-write bookkeeping systems using shingled checks and the like, and more particulary to such systems in which there are provided removable record sheets for recording the information being written on the shingled forms.

One-write bookkeeping systems have become extremely popular since they are an economical means of ensuring accurate entry of data from checks and the like into the permanent record sheets. Generally, one-write systems employ posts or rings along one side of a board or panel onto which is mounted a shingled assembly of checks or the like. A record keeping sheet is disposed under the shingled checks and, as information is entered on a check, it is simultaneously recorded on the underlying record sheet either through a carbon coating upon the check or by chemical interaction between coatings on the opposed faces of the check and record sheet.

Use and replacement of single record sheets with each new shingled stack presents the potential for misplacing the record sheets removed from the binder. In more useful systems, a series of ledger or other record sheets are mounted on rings in a binder at a point spaced from the locating elements and pivoted on the rings, one at a time, into a position underlying the shingled checks to record the information being entered on the checks. A new sheet is placed under each new shingled stack.

In some assemblies, the record sheets are loose and the rings open to permit removal and insertion, and this can result in their loss or disarray when removed from the binder. Moreover, unless placed in a protective storage unit, they may be damaged during storage.

It is an object of the present invention to provide a novel one-write bookkeeping assembly of the type employing a shingled set of forms mounted upon locating elements, and a removable insert providing a multiplicity of record keeping sheets for movement into operative position and which provides a compact storage assembly when removed from the binder.

It is also an object to provide such a bookkeeping assembly which is simply and quickly assembled.

Another object is to provide such an assembly which is easy to use and attractive.

SUMMARY OF THE INVENTION

It has now been found that the foregoing and related objects may be readily attained in a one-write bookkeeping assembly comprising a foldable posting book cover having a pair of panels hinged along an intermediate fold. One of the panels has a multiplicity of locating elements spaced along the outer end thereof, and it also has a pocket formed on its inner surface and opening towards the fold.

A removable insert member is seated on the posting book cover and has a multiplicity of spaced rings disposed in alignment with the fold of the cover. A multiplicity of record keeping sheets are perforated along one edge and slidably seated on the rings for pivotal movement between positions overlying each of the panels. The insert member has mounting panel means secured on the rings to releasably retain the insert in the book cover, and this includes a first panel extending into the pocket and a second panel extending over the one panel with apertures adjacent its outer end through which the locating elements extend. At least one of the record keeping sheets is pivoted into a position overlying the second panel.

In the cover is a set of shingled forms having perforations in a portion adjacent one side through which the mounting elements extend. The shingled forms overlie one of the record keeping sheets, and at least one of adjacent surfaces of the forms and the record sheets has means thereon for recording selected data on the record keeping sheet when the data are being entered on the forms.

In the preferred embodiment, the locating elements comprise horizontally oriented rings and the forms of the shingled assembly comprise checks and may also comprise receipts, vouchers and the like. The sheets of the insert have indicia imprinted therein providing columns and rows aligned with data entry portions of the checks.

Desirably, the first and second panels of the panel means are formed by a folded single sheet, and the fold line thereof is disposed inwardly of the rings. The folded sheet is formed from relatively stiff sheet material and is disposed on one side of the multiplicity of the sheets. The insert also has a cover panel of relatively stiff sheet material, and it is disposed on the other side of the multiplicity of sheets and against the other panel of the book cover.

DETAILED DESCRIPTION OF PREFERRED EMBODIMENT OF THE INVENTION

Figure 8:
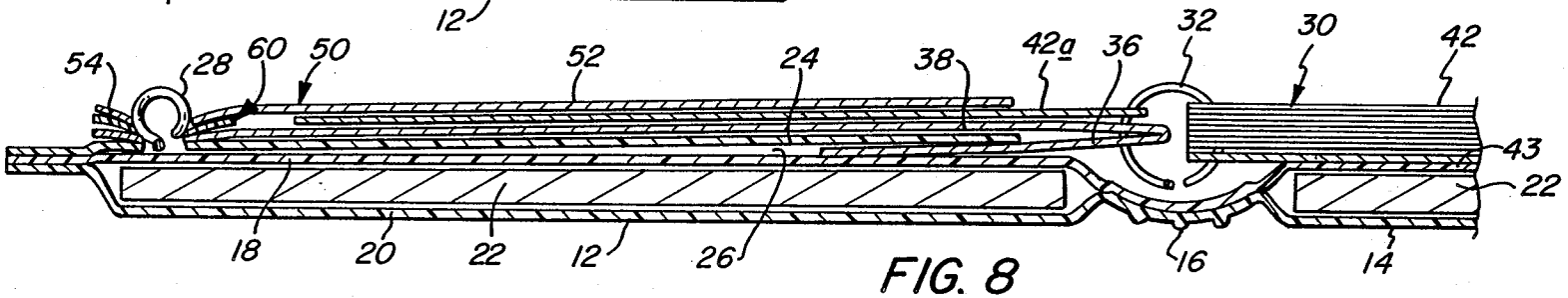
FIG. 8 is a fragmentary sectional view to an enlarged scale along the line 8—8 in FIG. 5 and with a single check of the shingled assembly being positioned on the locating elements.

A one-write bookkeeping assembly embodying the present invention is illustrated in the attached drawings as having a binder or base member generally designated by the numeral 10 and comprised of a pair of panels 12, 14 hinged together along a central web or spine portion 16. As best seen in FIG. 8, the binder 10 is formed from a pair of sheets 18,20 of flexible material which receive a pair of rigid planar members 22 therebetween and which are bonded thereabout to retain them therebetween and provide the panels 12, 14. A top sheet 24 of flexible material is bonded to the inside sheet 18 of the panel 12 to provide a pocket 26 opening adjacent the spine portion 16.

Figures 3, 4:
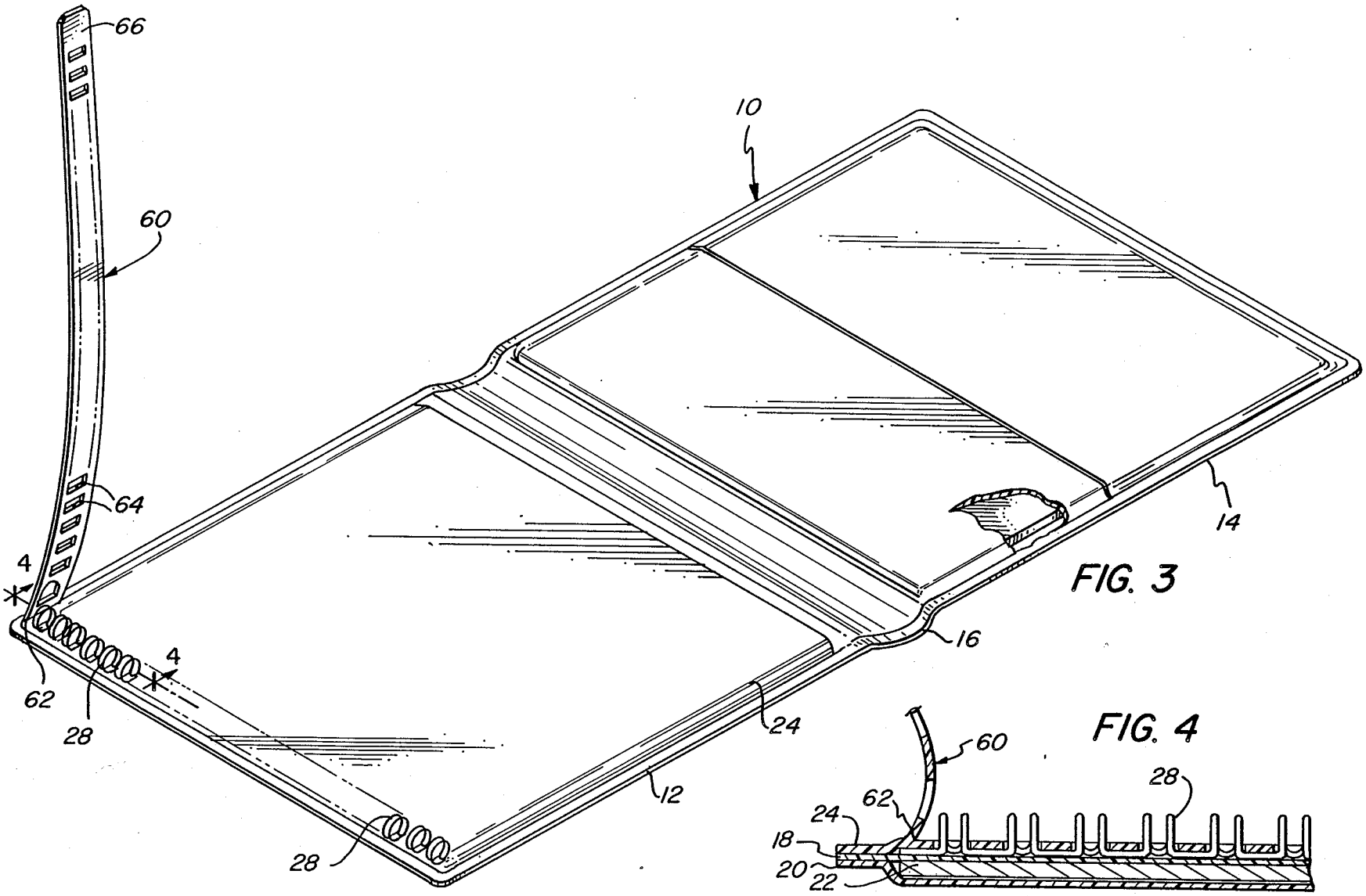
FIG. 3 is a perspective view of the fully opened binder of the assembly of FIG. 1 and showing the peel strip pivoted upwardly and a portion of the binder broken away to reveal internal construction.
FIG. 4 is a fragmentary sectional view along the line 4—4 of FIG. 3 drawn to an enlarged scale.

A locating member comprising a series of horizontally disposed rings 28 is formed of a continuous wire as seen in FIG. 4 and is spaced along the outer edge of the panel 12. The rings 28 extend upwardly through apertures in the top sheet 24.

A removable insert generally designated by the numeral 30 is securely seated in the cover 10 and has a series of spaced horizontally disposed rings 32 upon which is pivotably seated a mounting panel 34 of relatively stiff sheet material. The panel 34 is folded to provide a relatively short lower flap 36 which snugly seats in the pocket 26, and a relatively long upper flap 38 which extends across the top sheet 24 and which is provided with apertures 40 at its free end to seat snugly on the rings 28. Through this engagement of the flaps 36, 38 with the panel 12, the insert 30 is held in a predetermined position thereon.

Figure 5:
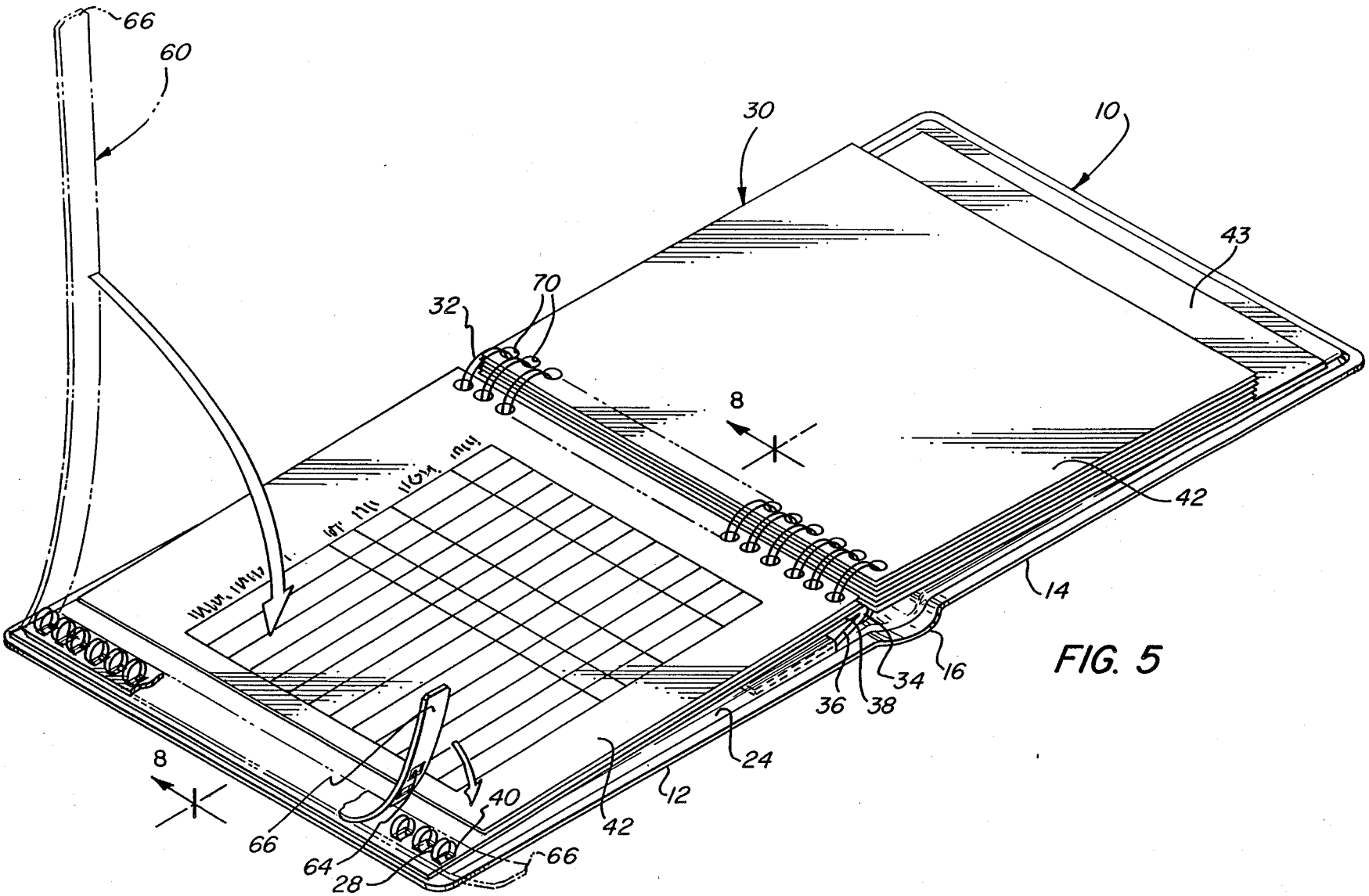
FIG. 5 is a perspective view of the assembly of FIG. 1 with the binder in the open position with the shingled assembly removed, and with the peel strip shown in full line as partially seated on the locating elements and in phantom line in the pivoted position and fully seated position.
Figure 9:
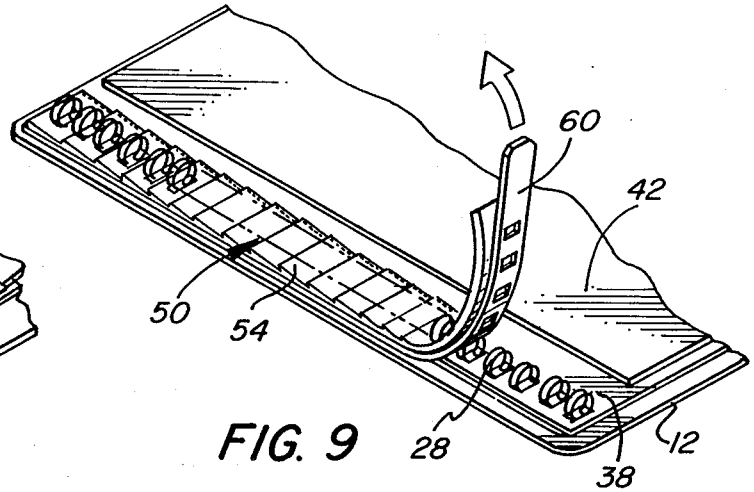
FIG. 9 is a fragmentary perspective view of the assembly in FIG. 6 with the peel strip being lifted to remove the skeleton of the shingled assembly.

Also pivotably mounted on the rings 32 are a series of recording or ledger sheets 42, one of which (42*a*) is shown in FIGS. 5 and 8 as pivoted into a position overlying the panel 12. The sheets 42 are provided with perforations 70 along one edge and through which the rings 32 extend. As seen in FIG. 5 the sheets 42 are printed with column headings and with lines dividing a portion of the face thereof into rows and columns. Another relatively stiff panel 43 is provided on the opposite side of the sheets 42, and the panels 34,43 to provide a protective cover for the sheets 42 when removed.

Figure 6:
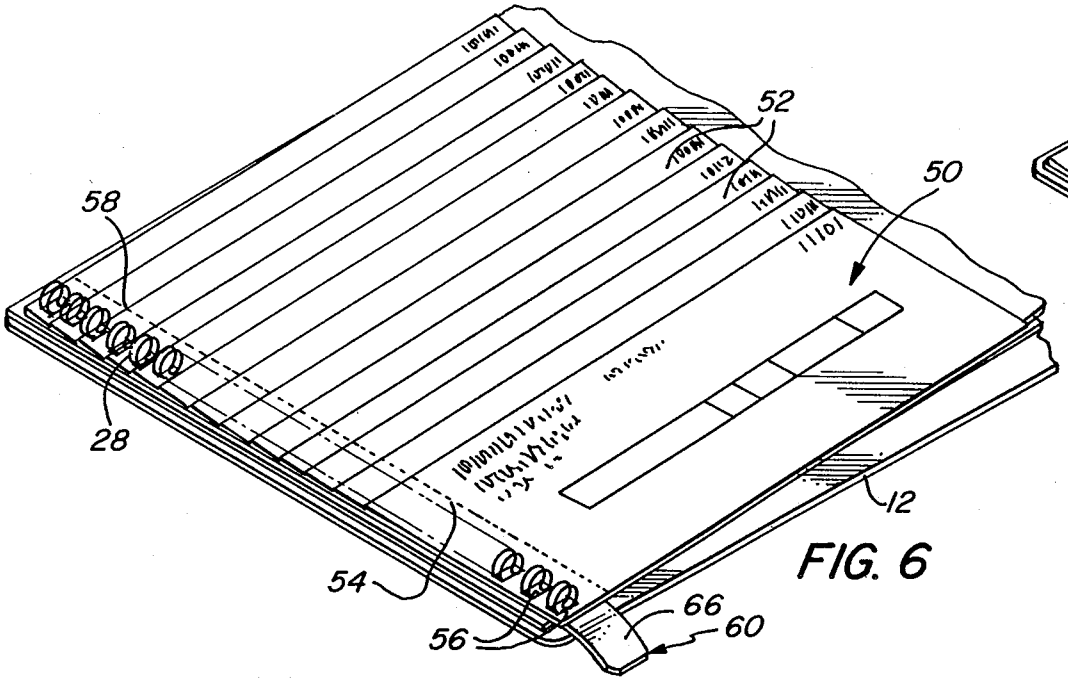
FIG. 6 is a fragmentary perspective view of the record keeping assembly in the open portion and with the shingled assembly in position.
Figure 7:
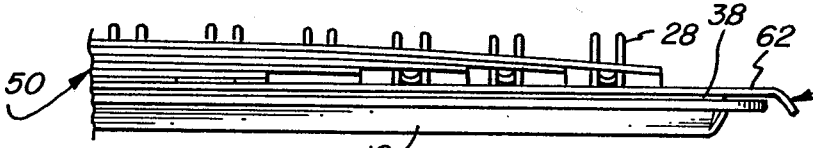
FIG. 7 is a fragmentary end illustrational view of the assembly in FIG. 6.

Seated on the rings 28 is a shingled assembly generally designated by the numeral 50 and which is comprised of a series of overlapping or shingled elongated sheets 52 which are bonded together along their one side portion 54 and which are provided with apertures 56 in that side portion 54 to seat snugly on the rings 28. As seen in FIG. 6, the shingled sheets 52 are imprinted with indicia and with sections for entry of data which are aligned with the columns and rows of the recording sheets 42 for recordation of that data. Desirably, the shingled sheets 52 are perforated or scored adjacent the side portion 54 as indicated by the dotted line 58 so that they may be readily severed and removed while leaving the side portion 54 as a skeleton on the rings 28.

An elongated flexible peel strip generally designated by the numeral 60 has its one end portion 62 adhered to the panel 12 and is provided with a series of apertures 64 along its length so as to fit over the rings 28. In normal use, it is disposed between the upper flap 38 and the shingled assembly 50. Its length is sufficient for its free end portion 66 to project beyond the lower edge of the panel 12 so that this projecting portion may be readily gripped to pull upwardly thereon.

Figure 1:
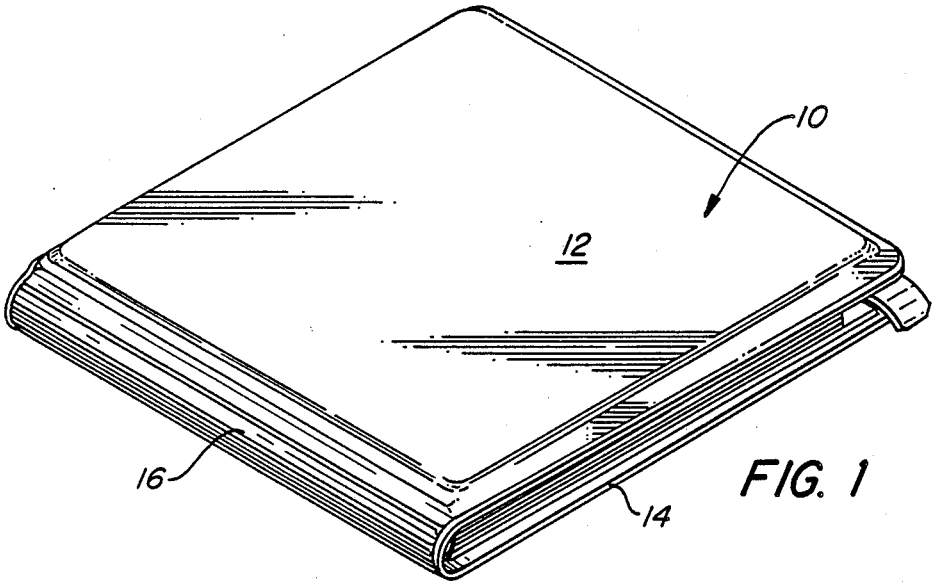
FIG. 1 is a perspective view of a one-write record keeping assembly embodying the present invention with the binder in the closed position.
Figure 2:
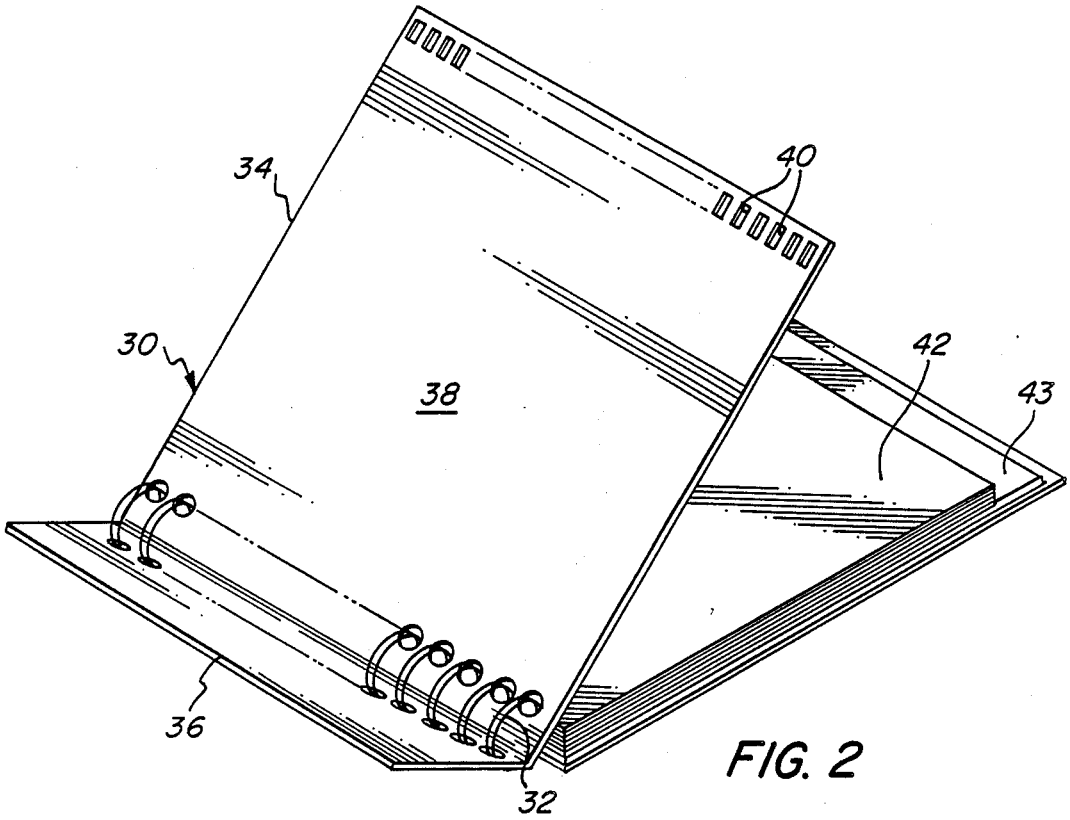
FIG. 2 is a perspective view of the removable insert utilized in the assembly of FIG. 1 with the mounting element pivoted upwardly.

In preparing the assembly, a removable insert 30 is placed in a position overlying the panel 14 and the mounting panel 34 is pivoted to the position seen in FIG. 2. The insert 30 is then moved towards the panel 12 to slide the lower flap 36 into the pocket 26. The upper flap 38 is then pivoted downwardly to push the rings 28 through the apertures 40 therein. At this point, the insert 30 is securely positioned on the cover 10 with its rings 32 disposed over the web or spine 16.

In use of the illustrated bookkeeping assembly, a fresh recording sheet 42 is pivoted into a position overlying the panel 12, and a fresh shingled assembly 50 of shingled sheets or checks 52 or the like is mounted on the rings 28 over the peel strip 60. The checks 52 below the topmost are pivoted to expose the topmost check, and, as that check is written, the name and amounts are entered on the check 52, the data is simultaneously recorded on the underlying recording sheet 42. The check 52 is then severed along the score line 58, and the next check 52 pivoted into recording position. To remove the remaining side portion or skeleton 54 of the peel strip 60 after all the checks 52 of the shingled assembly have been severed, the end portion 66 is gripped and lifted upwardly as seen in FIG. 6 to lift the apertured side portion 54 from the rings 28.

A new sheet 42 is then pivoted onto the panel 12, and a new shingled assembly 50 is then placed thereover. After all the sheets 42 have been used, the flap 38 is pivoted upwardly from the rings 28, and the insert 30 is moved over the panel 14 to withdraw the flap 36 from the pocket 26. The insert can then be removed from the cover 10, and the panels 34,43 provide a cover for the sheets 42 which are disposed therebetween.

The removable insert will generally contain 12–36 record keeping sheets which are relatively flexible paper elements. The panel 43 is conveniently fabricated from relatively stiff paperboard or synthetic resin sheet material. The large flap 38 of the mounting panel 34 is conveniently fabricated from relatively stiff synthetic resin sheet material, but other materials such as paperboard may also be used.

The binder or base member of the bookkeeping assembly may have a number of forms in addition to the two panel binder illustrated. For example, the present invention may be employed with a three panel one-write pegboard assembly of the type which is widely employed. Conveniently, synthetic resin sheet material provides the facing for the structure and rigid planar elements such as rigid plastic sheet or paperboard stock are encased therewithin as in the illustrated embodiment. The plastic sheet material covers offer an advantage in that they may be readily heat sealed about the rigidifying members and provide relatively durable surface.

The locating elements may be formed by a spiral continuous ring structure of the type illustrated, fabricated from metal or synthetic resin. However, separate rings or posts may be supported on a common planar base element which is then secured to the panel by adhesion or by mechanical fasteners.

The shingled assembly will normally comprise elongated elements such as checks, receipts, vouchers and the like with a row of perforations spaced along the one side edge thereof, and these perforations are cooperatively dimensioned and configured to snugly seat the locating elements of the binder. As previously indicated, the checks and like elements are generally scored adjacent the adhered marginal portion to provide a weakening line for severing them after they are written. This will leave a skeleton comprising the adhered marginal portion of the original shingled assembly.

The peel strip is conveniently fabricated from a flexible and relatively high tensile strength such as leather, synthetic resin sheet material such as polyvinyl chloride. It may be bonded to the binder by heat sealing or adhesive or it may be secured by mechanical means such as riveting or stapling to the rigid planar member within the panel. The preferred peel strips are provided with perforation as indicated in the illustrated embodiment to allow the peel strip to be fitted directly over the locating elements and thereby to exert most effective lifting pressure on the skeleton of the shingled assembly disposed thereover. However, the peel strip may also extend along one side of the locating elements so long as it is closely adjacent thereto and the portion of the skeleton of the shingled assembly disposed thereover is sufficiently large and stiff to enable the peel strip to effectively lift the skeleton from the locating elements. Moreover, a pair of elongated strips located on opposite sides of the locating elements may be lifted as a single unit so that lifting pressure is placed upon the skeleton on both sides of the locating elements.

Thus, it can be seen from the foregoing detailed description and the accompanying drawings that the bookkeeping assembly of the present invention is one in which an insert containing record keeping sheets may be readily removed from the locating elements of the assembly and stored. The assembly may be fabricated relatively economically and easily from components which themselves are relatively economical, and the assembly is one which is easy to use and exhibits relatively long life.

Having thus described the invention, what is claimed is:

1. A one-write bookkeeping assembly comprising:
(a) a foldable posting book cover having a pair of panels hinged along an intermediate fold, one of said panels having a multiplicity of locating elements spaced along the outer end thereof, said one panel also having a pocket formed on its inner surface and opening towards said fold; and
(b) a removable insert member seated in said posting book cover and having a multiplicity of spaced rings disposed in alignment with said fold of said cover, said insert member having a multiplicity of record keeping sheets perforated along one edge and slidably seated on said rings for pivotal movement between positions overlying each of said panels, said insert member additionally having mounting panel means secured on said rings to releasably retain said insert in said book cover, said panel means including a first panel extending into said pocket, said panel means also including a second panel extending over said one panel with apertures adjacent its outer end through which said locating elements extend, at least one of said record keeping sheets being pivoted into a position overlying said second panel; and
(c) a set of shingled forms having perforations in a portion adjacent one side through which said mounting elements extend, said shingled forms overlying said one of said record keeping sheets, at least one of adjacent surfaces of said forms and said one sheet having means thereon for recording selected data on said recording keeping sheet when said data are being entered on said forms.

2. The bookkeeping assembly of claim 1 wherein said locating elements comprise horizontally oriented rings.

3. The bookkeeping assembly of claim 1 wherein said shingled forms comprise checks.

4. The bookkeeping assembly of claim 1 wherein said sheets of said insert have indicia imprinted therein providing columns and rows aligned with data entry portions of said forms.

5. The bookkeeping assembly of claim 1 wherein first and second panels of said panel means are formed by a folded single sheet, the fold line thereof being disposed inwardly of said rings.

6. The bookkeeping assembly of claim 5 wherein said folded single sheet is formed from relatively stiff sheet material is disposed on one side of said multiplicity of said sheets.

7. The bookkeeping assembly of claim 6 wherein said insert includes a cover panel of relatively stiff sheet material disposed on the other side of said multiplicity of sheets and against the other one of said pair of panels of said book cover.

8. A one-write bookkeeping assembly comprising:
(a) a foldable posting book cover having a pair of panels hinged along an intermediate fold, one of said panels having a multiplicity of locating elements spaced along the outer end thereof, said one panel also having a pocket formed on its inner surface and opening towards said fold; and
(b) a removable insert member seated in said posting book cover and having a multiplicity of spaced rings disposed in alignment with said fold of said cover, said insert member having a multiplicity of record keeping sheets perforated along one edge and slidably seated on said rings for pivotal movement between positions overlying each of said panels, said insert member additionally having mounting panels means secured on said rings to releasably retain said insert in said book cover, said panel means including a first panel extending into said pocket and a second panel extending over said one panel with apertures adjacent its outer end through which said locating elements extend, at least one of said record keeping sheets being pivoted into a position overlying said second panel, said second panel providing a cover for one side of said multiplicity of record sheets, said insert having a cover panel of relatively stiff sheet material disposed on the other side of said multiplicity of sheets and against the other one of said pair of panels of said book cover; and
(c) a set of shingled checks having perforations in a portion adjacent one side through which said mounting elements extend, said shingled checks overlying said one of said record keeping sheets, at least one of adjacent surfaces of said forms and said one sheet having means thereon for recording selected data on said recording keeping sheet when said data are being entered on said forms, said sheets of said insert having indicia imprinted therein providing columns and rows aligned with date entry portions of said checks.

9. The bookkeeping assembly of claim 8 wherein said locating elements comprise horizontally oriented rings.

10. The bookkeeping assembly of claim 8 wherein first and second panels of said panel means are formed by a folded single sheet, the fold line thereof being disposed inwardly of said rings.

11. The bookkeeping assembly of claim 10 wherein said folded single sheet is formed from relatively stiff sheet material.

* * * * *